US005190181A

United States Patent [19]

Büdenbender

[11] Patent Number: 5,190,181

[45] Date of Patent: Mar. 2, 1993

[54] CONTAINER WITH CAP-TYPE CLOSURE

[76] Inventor: Bernd Büdenbender, Schubertweg 5, 2160, Stade, Fed. Rep. of Germany

[21] Appl. No.: 769,295

[22] Filed: Oct. 1, 1991

Related U.S. Application Data

[62] Division of Ser. No. 393,703, Aug. 14, 1989, Pat. No. 5,052,576.

[30] Foreign Application Priority Data

Mar. 13, 1988 [DE] Fed. Rep. of Germany ..... 3827551
Aug. 29, 1988 [DE] Fed. Rep. of Germany ..... 3829230
Aug. 29, 1988 [DE] Fed. Rep. of Germany ..... 3829240

[51] Int. Cl.[5] ..... B65D 41/04
[52] U.S. Cl. ..... 220/288; 220/304
[58] Field of Search ..... 220/288, 304

[56] References Cited

U.S. PATENT DOCUMENTS

| | | | |
|---|---|---|---|
| 2,380,871 | 7/1945 | Robinson | 220/288 X |
| 2,387,990 | 10/1945 | Grosser | 220/288 X |
| 2,460,721 | 2/1949 | Thompson | 220/288 X |
| 2,705,088 | 3/1955 | Van Blarcom | 220/304 X |
| 2,893,590 | 7/1959 | Buckley | 220/304 |
| 3,152,718 | 10/1964 | Weatherhead, Jr. | 220/288 X |
| 4,316,318 | 2/1982 | Mineo | 220/288 X |

*Primary Examiner*—Allan N. Shoap
*Assistant Examiner*—Nova Stucker
*Attorney, Agent, or Firm*—Herbert Dubno; Yori Kateshov

[57] ABSTRACT

A cap-type container has a tube stub formed directly from sheet metal of the container cover and from which the opening can be shaped. The tube stub is externally threaded and cooperates with a cap provided with a sealing ring engaging an annular surface of the tube stub. The latter can be double walled and a reinforcing ring inserted between the walls.

8 Claims, 6 Drawing Sheets

CONTAINER WITH CAP-TYPE CLOSURE

CROSS-REFERENCE TO RELATED APPLICATIONS

This application is a division of Ser. No. 07/393,703 filed Aug. 14, 1989 (U.S. Pat. No. 5,052,576 issued Oct. 1, 1991) and is related to the commonly owned copending applications Ser. No. 07/237,904 filed Aug. 29, 1988 (U.S. Pat. No. 4,905,858), Ser. No. 07/240,315 filed Sep. 2, 1988 (U.S. Pat. No. 4,934,551) and Ser. No. 07/300,459 filed Jan. 19, 1989 (U.S. Pat. No. 4,945,202).

FIELD OF THE INVENTION

My present invention relates to a container with a cap-type closure and, more particularly, to a cap-type cask, barrel, drum or tank (which can be open-topped or closed-top) composed of sheet metal and having a screw-type cap which can be applied matingly to a tubular fitting

BACKGROUND OF THE INVENTION

A cap-type container of the kind with which the invention is concerned, generally has a body, a bottom rigidly and sealingly connected to the body and a top or cover likewise rigidly and sealingly connected to the body, e.g. by a folded seam at the upper chime of the body The cover has at least one filling opening, which may hereinafter be referred to as a bunghole, surrounded by a tubular fitting over which a cap can be applied. The cap can have an internal screwthread which mates with an external screwthread on the fitting to provide a liquid tight and gas tight closure for the drum, cask or barrel.

A cap-type container of the kind described, composed of relatively thin sheet metal, can be used as a barrel or drum for a variety of liquids or flowable bulk solids. It can be used as a cask for beverages, e.g. as a beer barrel or keg.

Generally the wall thickness of the structure forming the bunghole must be relatively large in conventional barrels so that a threaded fitting adapted to form or surround the bunghole is attached to the cover of the drum or barrel by a screw connection, by rolling over sheet metal portions, by a pressing operation or by welding the fitting in or onto the cover.

As a consequence, fabrication of the container requires a larger number of parts than may be desirable to form a cover which is satisfactory and also mandates a number of fabrication steps to ensure a firm attachment of the fitting and a sealing between the fitting and the cover which can increase the cost of fabrication of the barrel to an excessive degree. Special means may be required for providing a seal between the bung and the cover and such means can include additional sealing rings.

The conventional constructions are, however, fraught with a number of problems. For example, drop tests have shown that the region between a rigid fixture or fitting and the thin sheet metal cover is subjected to local stresses which can destroy the connection or so damage it that leakage can occur.

The provision of sealing rings between the fitting and the cover not only means that additional elements are required but that a variety of considerations in the handling of the container will arise. For example, many conventional types of elastic sealing rings may not be resistant to the substances with which the container is to be filled so that the use of such sealing rings must take into consideration the ultimate use of the container and the products which are to be packaged or transported therein.

Furthermore, the use of elastic sealing rings may impede the handling of the containers since the seals may be affected by solvents and cleaning agents used in cleaning the container or by high temperatures utilized in the cleaning process.

Indeed, if the container is equipped with an elastic ring between the fitting and the cover, a variety of cleaning agents may be excluded from use and it may not be possible to employ elevated cleaning temperatures.

OBJECTS OF THE INVENTION

It is, therefore, the principal object of the present invention to provide an improved metal container of the cap-closure type which is free from the aforementioned drawbacks, can allow the use of a threaded cap with high sealing reliability and which can be fabricated at a minimum cost.

Another object of this invention is to provide an improved cap-type container which will be less susceptible to local stress and will maintain sealing effectiveness even when subjected to handling of a type which in the past may have sprung the connection between the fittings of earlier barrels or drums and the respective covers.

SUMMARY OF THE INVENTION

These objects and others which will become apparent hereinafter are attained, in accordance with the invention by providing a container which may be a cask, drum or barrel or an open top or closed top tank and in which the opening or hole, referred to conveniently as a filling opening but capable of being used alternatively for filling and/or emptying is surrounded by an outwardly extending tube stub which is formed in one piece from a wall portion of the container and surrounds the filling opening, is formed with an external screwthread and receives an internally threaded screwcap while defining an annular sealing surface against which a sealing ring of the screwcap can be pressed.

In the case of a barrel, drum or cask, the tubular fitting is formed from a portion of the cover which is deformed to provide the filling opening and the annular sealing surface can be a portion of the cover immediately adjoining the foot portion of the tube stub, a step formed in the tube stub as a corrugation or the like, or a free end portion of the tube stub or a transition portion or bend between an upstanding wall and a downwardly turned wall of the tube stub.

According to the invention, therefore, instead of the conventional welded, bolted, pressed, rolled or otherwise attached, separately fabricated, massive, thick-walled tubular fitting, of the type required by the prior art construction, a simple, easily fabricated tube stub is provided in one piece with the material which is deformed to form the filling opening from the cover and thus is unitary with the cover and sealingly is formed thereon without the need for additional sealing agents, sealing rings or the like.

According to the invention, material of the cover which would otherwise have to be removed to form the opening of the desired caliber, is deformed to form the tube stub which remains in one piece with the cover and can also form the sealing surface for the sealing ring, projects from the cover and is provided with the external screwthread by this sealing surface for engagement with the cap.

As noted, it is also possible to provide the sealing surface for the sealing ring at the free end of the tube stub. What is important, in either embodiment, is that the tube stub be entirely formed from the material of the cover or be at least in part provided from the material of the cover so that any additional elements required for reinforcement or the like can be applied in a simple manner without the need to fabricate such elements with high tolerances and in such manner that, even if such parts leak, there will be no leakage of the closure assembly as a whole because the sealing is provided either upstream of any low tolerance or sensitive regions or downstream thereof to seal such parts within the container Another advantage, of course, is that the closure be simply fabricated.

According to a feature of the invention, the tube stub is axially compacted on formation so that it has a greater wall thickness than the wall thickness of the cover from which it is deformed.

The screwthread can be provided by cutting, rolling, twisting, embossing or otherwise deformed The tube stub and/or an additional sealing surface can be provided by a step formed therein An inwardly turned flange at the free end of the tube stub may form a sealing surface as well.

According to another feature of the invention, the upstanding portion of the tube stub forms an inner wall which extends into an outwardly turned transition region which can then extend into an outer wall surrounding the inner wall and reaching back toward the cover. The external screwthread is then formed on this outer wall A space can be provided between the inner and outer walls to decrease the sensitivity of the tubular fitting to shock. The transition portion here can define an annular surface for cooperation with the sealing ring of the cap.

According to another feature of the invention, the inner wall may be stepped inwardly while the outer wall comes to lie against the inner wall so that a bulge is formed at the upper end of the tube stub to provide the sealing surface.

In another feature of this aspect of the invention, a tight bend can be provided between the inner and outer walls so that these walls lie against one another over the full length of the outer wall. The upper portion of the tube stub may then have an outwardly diverging or inwardly diverging frustoconical surface for cooperation with the sealing ring of the cap.

A reinforcing ring can be provided between the inner and outer walls if desired.

According to another aspect of the invention, the free outer end of the tube stub can engage over a threaded ring which can have an external screwthread and can be of greater wall thickness than the sheet metal. The portion of the tube stub clenched over that ring can form the sealing surface for engagement by the sealing ring According to another aspect of the invention, the screwcap can receive the elastic ring which can engage the annular sealing surface of the cover, a corrugation or bulge of the tube stub or a free end or transition portion thereof.

Alternatively, the sealing ring can be omitted and the tube stub and the screwcap can have abutting, finely machined and preferably ground sealing surfaces. In the best mode embodiment, however, a resilient sealing ring is provided.

The outer screwthread of the tube stub, whether that is formed directly thereon or on a threaded ring, and the inner thread of the screwcap can form a bayonet-type or plug-type thread arrangement in which the screwcap can be displaced axially onto the tube stub so that threaded portions of the one pass between threaded portions of the other and then tightened thereon by a partial rotation of the cap on the tube stub.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
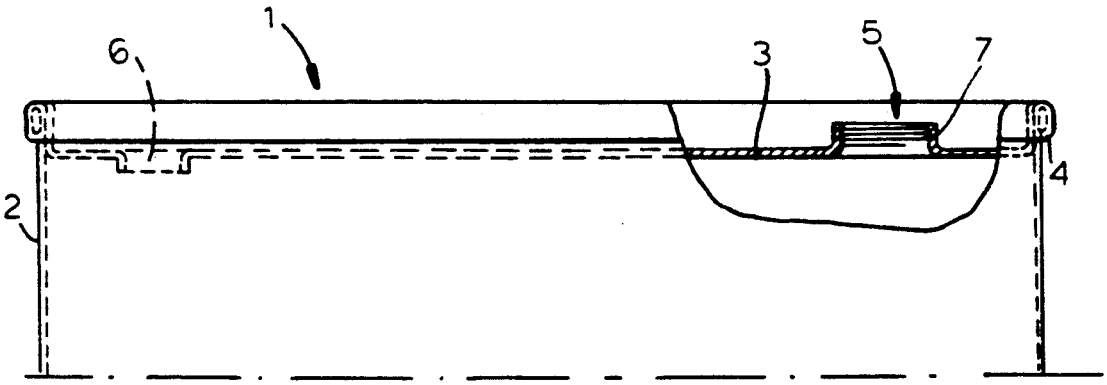
FIG. 1 is a diagrammatic partially broken away elevational view of the upper part of a barrel, drum or cask having two filling openings with closure assemblies in accordance with this invention.

FIG. 1 shows the upper portion of a drum, cask or barrel, partly broken away, and which comprises a drum body 2 closed, at its upper end, by a cover 3 mechanically fixed to the body and hermetically sealed thereto by a conventional drum fold 4 forming the chime of the drum.

The cover 3, which like the body 2 and the bottom of the drum (not shown) is composed of sheet metal, has two filling openings which can be of different diameters as is customarily the case. The larger of these openings 5, which forms a bunghole and can have a diameter of, say, two inches, can be used for the filling and emptying of the drum. The smaller of the openings, namely the opening 6, can be used primarily for venting during filling and discharge of the drum. This smaller opening 6 can have a diameter of about three-quarters of an inch.

The openings can be provided with cap closures as described below and at least one, but preferably both, are provided with tube stubs 7 to receive the closure The tube stub is formed with an outer or external screwthread and is adapted to receive removably, an internally threaded cap as will be described in greater detail below An annular seal on the cap can engage the container to seal the latter around the respective hole in a liquid-tight and gas-tight or hermetic manner.

Figure 2:
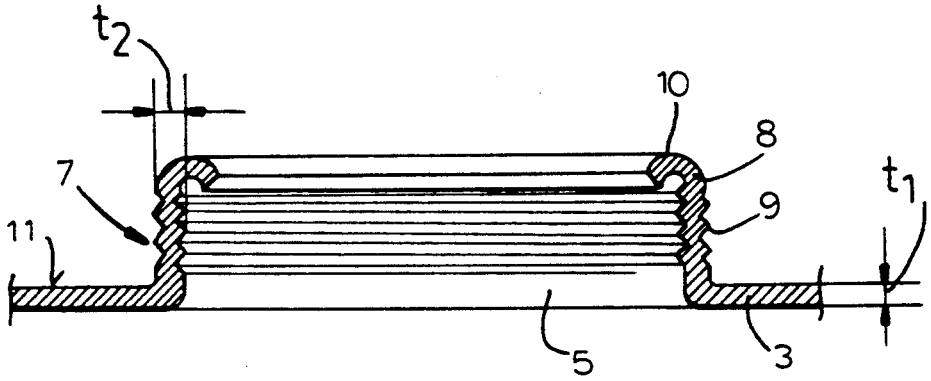
FIG. 2 is a cross sectional view through one of these filling openings defined by a simple tube stub deformed from the material of the cover which would otherwise have to be removed to provide the opening.

FIG. 2 shows one embodiment of the tube stub 7 in greater detail in an enlarged cross-sectional view. It will be understood that the details with respect to the stub and cap can apply to the smaller opening in the cover of the container, that the tube stub and cap can be provided on any wall of the container although it preferably is provided on the top wall or cover, and that the principles of the invention can be applied to tanks and other structures which may be open upwardly and can have a fitting which must be closed by a cap.

From FIG. 2, it will be apparent that the cover 3 can be formed with the filling or emptying hole 5, which may be referred to herein as an access hole, by initially stamping or punching the hole from an intermediate region of the sheet metal of the cover. Then the material of the cover-forming workpiece is pressed out of the cover plane concentrically with the hole so as to form a cap in one piece with the remainder of the cover. The tube stub is then formed from this cap which has been pressed out of the plane of the workpiece (see, for example, FIG. 10 of my copending application Ser. No. 07/393,702 filed concurrently herewith. The tube stub has an upwardly projecting tubular portion 8 which can be formed with an inwardly extending collar or flange forming an annular sealing surface at the free end of the tube stub 8. The annular sealing surface 10 can cooperate with a sealing ring of a cap as described below The annular surface can be further deformed to alter its configuration and can be formed as a transition region of an outwardly turned wall portion of the tube stub.

Between the root of the tube stub , i.e. the region at which it merges unitarily with the remainder of the cover 3, at the sealing surface, the tube stub 8 is formed with an external or outer screwthread 9. In the embodiment of FIG. 2, moreover, the surface 10 is formed as an inwardly turned corrugation so that sharp exposed edges can be avoided while providing an annular surface for sealing engagement by the sealing ring of a screwcap to be threaded onto the tube stub 8.

Especially when relatively thin tube stubs are made, it is possible for hairline cracks to arise in the screwthread and to weaken the tube stub. As suggested by FIG. 2, this danger can be reduced when, during the pressing which forms the tube stub, the latter is subjected to an axial compression or coining to thicken the tube stub relative to the cover 3, before the screwthread is formed in the tube stub. In this step, the axial height of the tube stub may be reduced somewhat.

It is also possible, and a feature of the invention, to use a screwcap on the tube stub 8 forming the bung assembly 7, which has a sealing ring on an outer ends engageable sealingly with an annular sealing surface 11 directly surrounding the root of the tube stub 8 where it merges with the cover 3. In this way I can eliminate entirely any effect on the sealing effectiveness by such hairline cracks or other defects, since the seal surrounds the tube stub and the matingly threaded members and, stated otherwise, any potential defects are sealed in the container.

Figure 3:
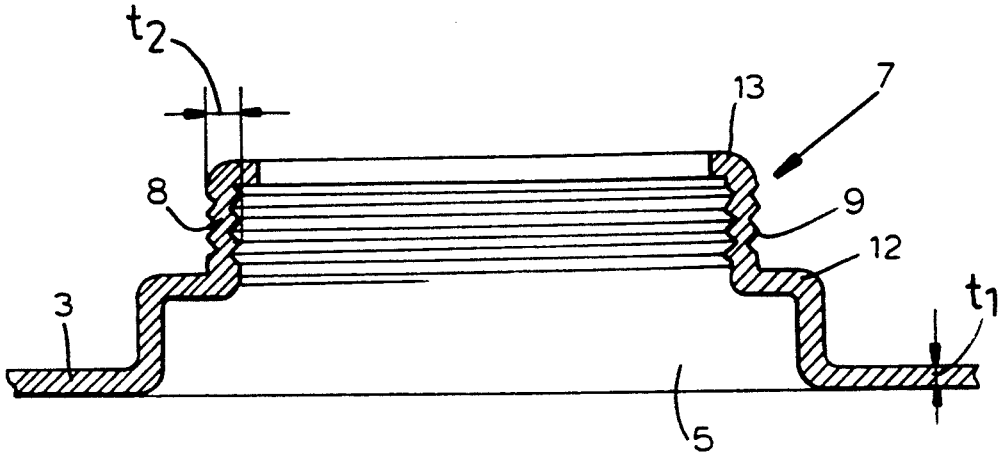
FIG. 3 is a view similar to FIG. 2 but wherein the tube stub is inwardly stepped to provide a sealing surface in the form of the outer shoulder formed by the step or corrugation.

In FIG. 3, I have shown another embodiment of a bung assembly 7 using the principles described Here the foot of the tube stub 8 is enlarged into a step or corrugation 12 so that the tube stub is stepped in cross section and the step 12 can form an upwardly turned planar annular sealing surface engageable by the sealing ring of the cap. The annular step 12 not only stiffens the foot region or junction between the tube stub 8 and the cover 3 by the profiling provided, but this profiling can also define the annular sealing surface. Of course the step or corrugation can be of nonrectangular profile as well. For example, it can have a wave-like or undulate cross section, it can be roof-shaped with an inverted-V cross section, or can have some other folded configuration which is pressed into the region of the cover 3 surrounding the tube stub 8.

Of course, as in FIG. 2, the upper free end of the tube stub 8 of FIG. 3 can have a simple inwardly turned flange 13 which can form an annular sealing surface engageable by a sealing ring of the cap as has been described.

Figure 4:
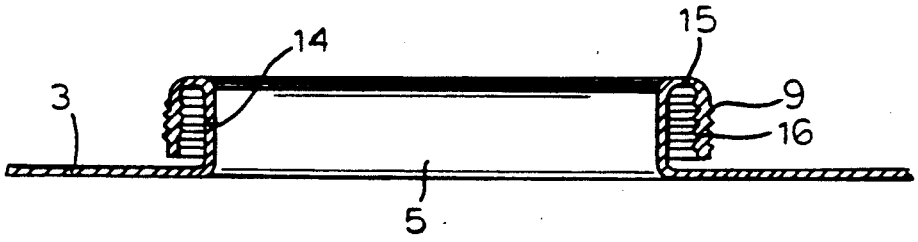
FIG. 4 is a cross sectional view of a tube stub which has been bent over to define a transition region capable of forming the sealing surface between inner and outer walls of the tube stub.

An embodiment capable of withstanding greater stress and shock than the embodiments already described has been shown in FIG. 4. In this embodiment, the tubular formation pressed in one piece from the sheet metal of the cover 3 and surrounding the opening 5 is folded back through 180° outwardly to define an inner wall 14 of the tube stub and an outer wall 16 thereof. A transition region 15 is formed between the inner and outer walls and has a planar annular upper sealing surface engageable by a sealing ring of a cap. The cap can be threaded onto the tube stub using an external screwthread formed in the outer wall 16. In this embodiment the wall 16 is spaced with all-around clearance from the wall 14 and the seal along the surface 15 is located inwardly of the screwthread connection using the thread 9. Defects in the threaded connection, for example hairline cracks or the like, will not, therefore, detrimentally affect the sealing of the container. The externally applied cap additionally stiffens the assembly outwardly of the sealing surface so that even if a deformation of the outer wall and cap should occur the seal will not be detrimentally affected.

In the embodiment illustrated, the transition region 15 has an annular surface normal or perpendicular to the axis of the tube stub and connected by curves or radiuses with the inner wall 14 and the outer wall 16. A complementary flat surface of the sealing ring can then engage this annular surface. However the annular sealing surface may have other effective shapes, for example a continuously curved cross section.

Figure 5:
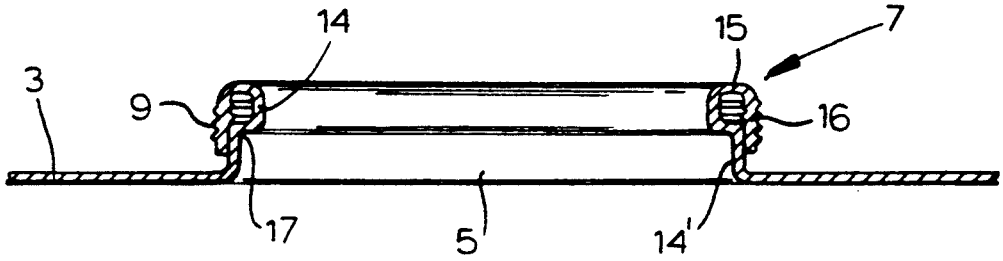
FIG. 5 is a cross sectional view of an embodiment which includes features of FIGS. 3 and 4, i.e. has a corrugation or step at the foot of the tube stub.

FIG. 5 illustrates a tube stub 7 according to the invention which has an inwardly extending step or bend 17 from which the inner wall portion 14 extends into the transition region 15. The outer wall 16 lies against the foot portion 14' of the inner wall. The hollow bead thus formed at the top of the tube stub provides additional stiffening. Here as well the transition region 15 can have a round or elongated profile defined between two quarter circle bends and constituting a sealing surface for engagement by the sealing ring of a cap engaging the external thread 19. The outer wall 16 may be welded with the surface of the corrugation 17 or the tubular potion 14' at a plurality of points or by a continuous weld seam (see the aforementioned application).

Figure 6:
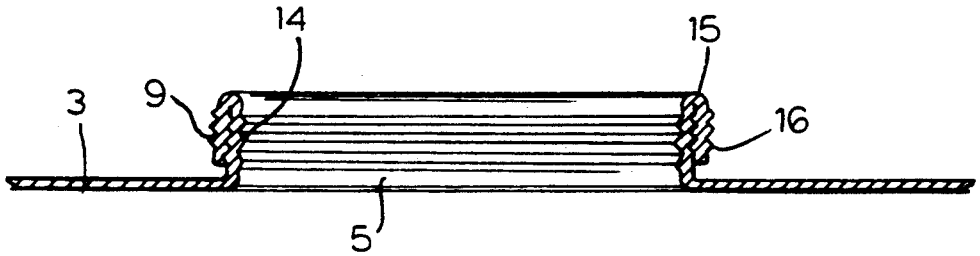
FIG. 6 is a cross sectional view of a modification of the embodiment of FIG. 5 in which the outer wall lies along the inner wall of the tube stub.

A further variant is shown in FIG. 6 in which the transition ring 15 has a minimum radius of curvature and the outer wall 16 directly abuts the inner wall 14 so that, upon press of the external screwthread into the outer wall 16, the inner wall 14 is correspondingly embossed. Welds as described can be provided in this embodiment and in the embodiment of FIGS. 7 and 8 as well.

Figure 7:
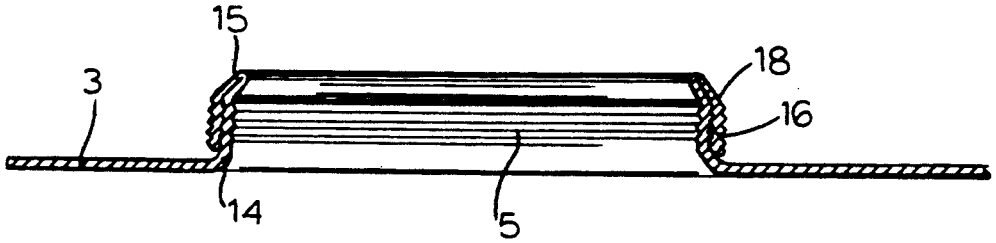
FIG. 7 is a cross sectional view of a further modification of this last variant but wherein a frustoconically upwardly converging or downwardly widening seal surface is provided.
Figure 8:
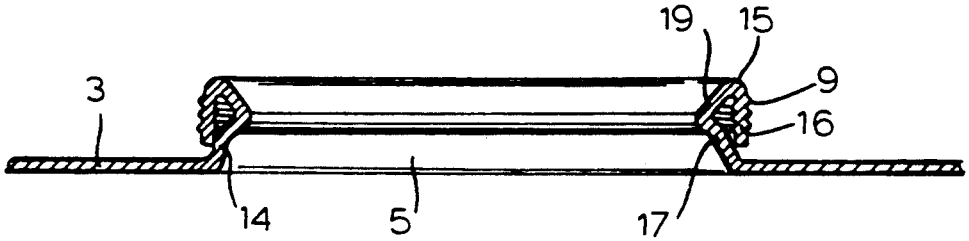
FIG. 8 is a cross sectional view of another embodiment with a frustoconically shaped sealing surface.
Figure 19:
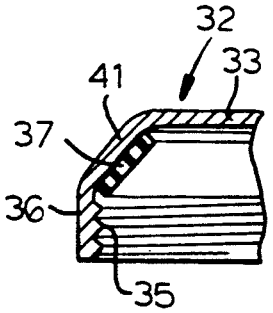
FIG. 19 is a view similar to FIG. 16 but showing the use of a sealing ring in a system in which the sealing surface converges inwardly and upwardly.

In the embodiment of FIG. 7, the transition ring 15 and the adjoining portions of the inner and outer walls are bent inwardly to form a frustoconical surface 18 which constitutes the sealing surface engageable by the sealing ring of a cap of the type shown in FIG. 19 for example. A relatively narrow sealing ring with high sealing pressures because of a wedging action can be used. It is also possible to simply engage the bend at the sealing ring An oppositely directed conical sealing surface can be provided as shown in FIG. 8. This type of construction can be made by bending the tube stub 14 from the material of the cover to define the filling opening 5 and then form a step or corrugation 17 therein as in FIG. 5. The portion of the inner wall above this step frustoconically widens outwardly at 19 to the transition region 154 from which the outer wall 16 extends downwardly to adjoin the corrugation 17. The combination of a corrugation and bulge of FIG. 8 allows sealing advantages of a frustoconical surface to be obtained together with greater stiffness.

Frustoconical shaping allows sealing with a relatively light tightening of the threaded communication between the cap and the tube stub by the pressing force which is augmented by the wedge action.

Bracing and stiffening are obtainable not only by the formation of corrugations, steps and bulges, as previously described, but also by the incorporation of stiffening or reinforcing rings in the tube stub.

The rings may be held in place by weld (see the aformentioned application).

Figure 9:
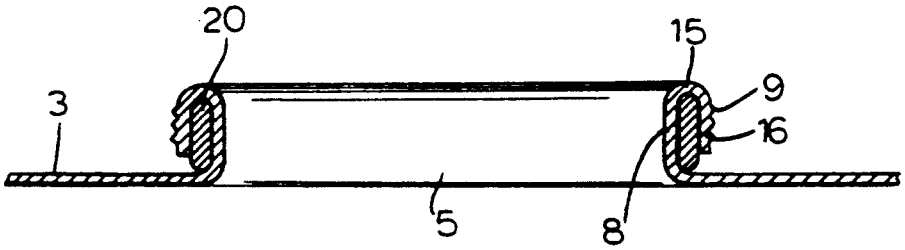
FIG. 9 is a cross sectional view through a double wall tube stub having a reinforcing ring inserted therein.

The reinforcement ring 20 in FIG. 9 is shown to be received between the free outer and of the downwardly turned wall 16 and the inner wall thereof. Advantageously, the transition region 15 engages over and is supported by the stiffening ring 20 which is additionally held by the outer wall 16 so that it is possible to forego a welding process while nevertheless securely retaining the reinforcing ring.

The outer screwthread 9 of FIGS. 1 through 9 can be formed by any of the usual threading processes. For example it is possible to cut the screwthreads with cutting jaws or by turning processes, e.g. using a cutting tool or threading die. However it is also possible to form the external thread by rolling it, pressing it or twisting it into the outer wall of the tube stub. By the latter methods it is possible to form effective screwthreads even in relatively thin sheet metal of the cover and it may be noted, in this connection, that the upward projection of the tube stub from the cover does not make formation of the external thread a problem since the tube stub is readily accessible to whatever threading tool may be used.

It has been found to be advantageous in some cases to reinforce the tube stub and simultaneously increase the versatility with which the thread can be formed by applying an externally threaded reinforcing ring to the tube stub.

Figure 10:
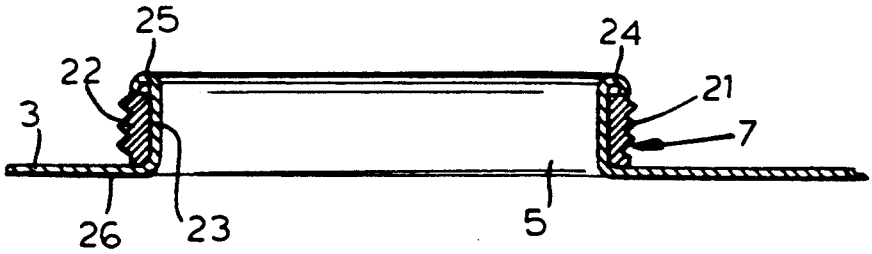
FIG. 10 is a cross sectional view of a tube stub having a threaded ring engaged thereby.

In FIG. 10, for example, I have shown a threaded ring 22 which has been previously machined to have an external thread, seated against a tube stub 23 formed in one piece with the cover by pressing, drawing or the like as previously described.

After the threaded ring 22 is placed on the tube stub 23, the upper free end 24 is clenched over it so that at least this end region is prestressed against the threaded ring 22 and the ring is clamped between the outwardly turned clenched portion 24 and the foot of the tube stub 23.

The retention of the threaded ring can be improved by roughening its upper flank 25 and/or its lower flank 26 or by providing these flanks with small depressions so that the ring is locked to the tube stub 23 against rotation during the clenching operation.

The threaded ring can be fabricated relatively easily as a separate element and is held in an easily made joint with the tube stub 23.

Advantageously, the sealing surface is formed by the clenched free end 24 of the tube stub.

The tube stub 23 and its upper free end 24 extend in one piece from the cover 3 so that absolute sealing between the tube stub and the cover is ensured.

Figure 11:
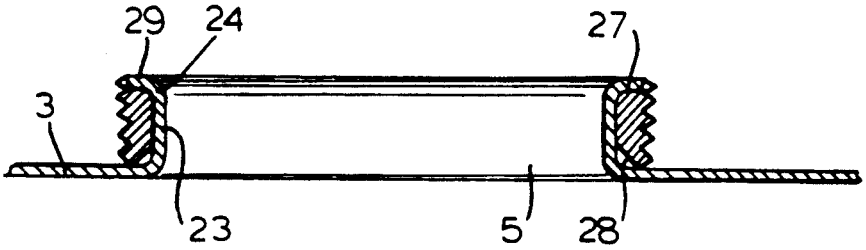
FIGS. 11 through 13 are cross sectional views similar to FIG. 10 showing other embodiments of engagement of the tube stubs over the threaded rings.

In the modification of FIG. 11, the upper flank of the threaded ring 22 is formed with a groove 27 which partly or completely receives the free end 24 of the tube stub 23 which is deformed into this groove. The resulting flange 29 lies at least in part in the groove 27 and forms a sealing surface cooperating with the sealing ring of a screwcap to be threaded onto the external thread 21 of the ring 22.

The lower end face of the threaded ring 22 can be provided with a notch or groove 28 which can provide a fixed connection with the cover 3 and the tube stub 23 even when the transition at the foot of the tube stub 23 has a larger radius of curvature.

Figure 12:
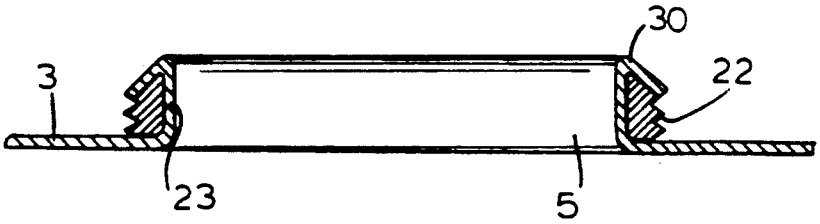

FIG. 12 illustrates a similar arrangement wherein, however, the free upper end of the tube stub 23 is deformed to an outwardly and downwardly diverging ring 30 forming a frustoconical surface engaging in a groove at the upper end of the threaded ring 22.

Figure 13:
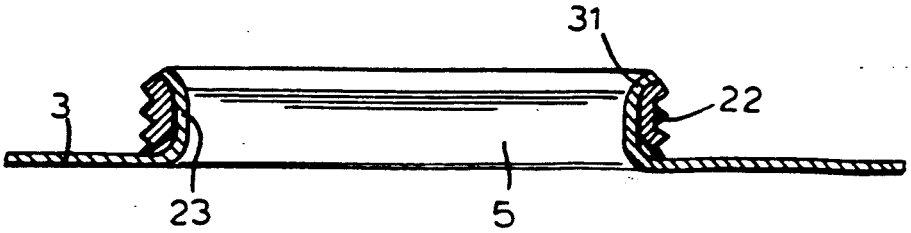
Figure 14:
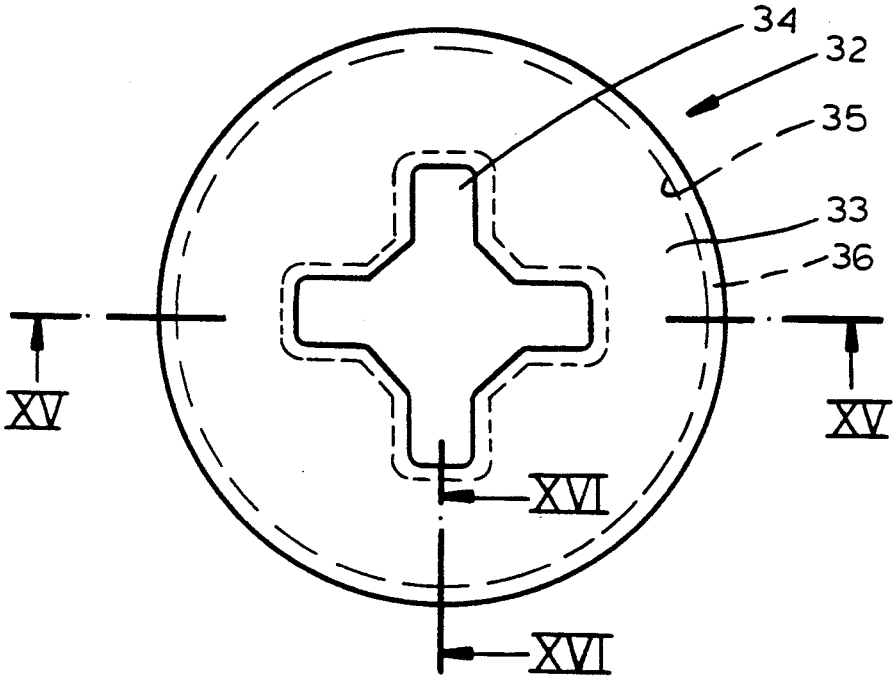
FIG. 14 is a plan view of a screwcap for use with the embodiments of the tube stubs described.

In the modification of FIG. 13, the free upper end of the tube stub 23 engages over the ring 22 with an outwardly and upwardly diverging frustoconical configuration whereas the opposite inclination is provided by the flange 30 of FIG. 12. These frustoconical surfaces can be engaged by the frustoconical seals of the caps illustrated in FIGS. 19 and 20 to be described.

FIGS. 14–20 illustrate the types of caps which can be used with the tube stubs of FIGS. 1–13. In general (see FIG. 14) the cap 32 will comprise a recess 34 in the bottom 33 of the cap for engagement by a tightening or loosening key. The recess 34 simultaneously serves to stiffen the cap by profiling.

Figure 15:
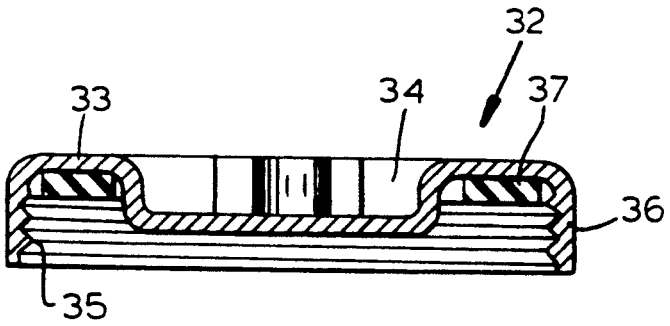
FIG. 15 is a cross sectional view taken along the line XVI—XVI of FIG. 14.

As can be seen from the cross sectional view of FIG. 15, the cap is provided with an internal or female screwthread 35 on a tubular collar 36 engaging over the tube stub of FIGS. 1–13 and mating with the external or male thread 9 thereof.

Since the material thickness often limits thread height or depth of the screwthread, it may be advantageous to employ special screwthread shapes, such as trapezoidal threads or multiple threads to reduce the number of rotations required to tighten the cap.

The annular region surrounding the recess 33 is formed with a sealing ring 37 which can have a configuration suited to the sealing surface of the tubular stub 7 of FIGS. 1–13. Variations of the screwcap are illustrated in the remaining figures which all can be considered to be sections along the line XVI—XVI of FIG. 14 and thus only the outer part of the screwcaps.

Figure 16:
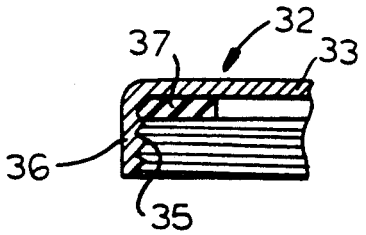
FIG. 16 is a cross sectional view of a portion of the screwcap taken along the line XVI—XVI of FIG. 14.

For example, in FIG. 16 the internal thread 35 of the collar 36 does not extend to the bottom 33 but rather terminates at an undercut groove in which the sealing ring 37 is seated. The groove thus holds the sealing ring in place and it is not necessary to use cement, glue or the like for that purpose.

Figure 17:
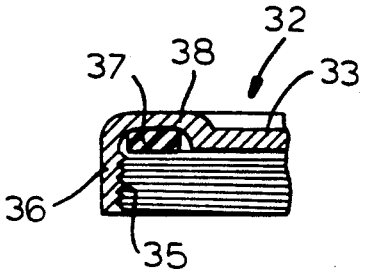
FIG. 17 is a view similar to FIG. 16 of the region in which the sealing ring is received.

In the embodiment of FIG. 17, the bottom 33 of the screwcap 32 is provided with a recess 38 which provides additional stiffening and also forms a defined seating surface for the sealing ring 37 which is accommodated in this recess If desired, a groove can be provided above the internal thread 35 to hold the sealing ring in place or the latter can be glued or cemented in the recess 38.

Figure 18:
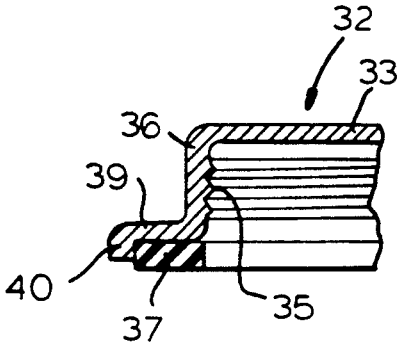
FIG. 18 is another cross sectional view of a screwcap showing a sealing ring seated in a recess or step along the edge of the screwcap.

FIG. 18 illustrates a further embodiment of a screwcap which can have any of the previously or subsequently described configurations but which also has a flange 39 extending its tubular collar 36 and provided with a rim 40 to positively position a sealing ring 37 on this flange.

The screwcap has a height which is slightly greater than that of the tube stub on which it is threaded so that a seal can be formed directly against the surface of the cover 3 or in the case of the step 12, against the latter. What is important, of course, is that the free end of the tube stub not bottom on the cap before the seal is made with the ring 37 or not impede the ring.

Figure 20:
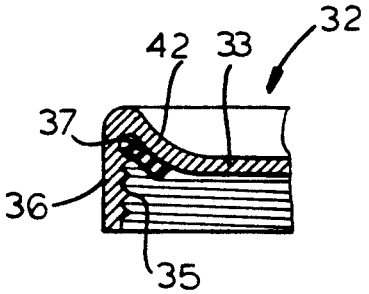
FIG. 20 is a corresponding view of an embodiment of the screwcap in which the sealing ring cooperates with a sealing surface converging inwardly and downwardly

Further variants of the screwcap are shown in FIGS. 19 and 20. In the embodiment of FIG. 19, the bottom 33 has a frustoconical region 41 provided with the sealing ring 37 for engagement with the sealing surface 18 of FIG. 7 or the corresponding surface of the embodiment of FIG. 12. A corresponding complementary arrangement of the seal is shown in FIG. 20 for the frustoconical portion 19 of FIG. 8 or the frustoconical ring 31 of FIG. 13 in the form of the frustoconical region 42 whose inner surface is provided with the sealing ring 37.

There are of course a variety of other variants possible within the spirit and scope of the invention to provide the sealing ring 37 and the sealing surface of the tube stub engaged therewith as finely machined, especially ground surfaces so that the sealing ring need not be elastic and the seal can be formed practically between two metallic surfaces. This is desirable when wear of the sealing ring would be advantageous since it generally eliminates wear.

Of course it is possible to provide the tube stubs not only in closed containers as has been described but also in one piece with other walls of these containers, such as the body or bottom of the container when, for example, lateral filling openings and closures are provided or when the container is an open top tank or the like. In all cases, with the invention there is a better utilization of material, a reduction or elimination of sealing problems since the material from the wall forms the tube stub, and there is a continuous uninterrupted piece of material between the cover or wall and the sealing surface. The transition and connection regions are located between yieldable elements and all junctions with rigid elements which might locally stress and damage thin walled members are avoided. The fact that the tube stub projects upwardly with an optimum caliber or lumen of the filling opening, unobstructed by additional fitting, facilitates emptying of a barrel, cask or drum and the filling thereof. The cost in fabrication and for materials can be reduced and the system has been found to be effective with highly viscous flowable materials. Since full width openings are available, agitators can be inserted or mechanical devices can be used to facilitate emptying.

I claim:

1. A cap-type closure container, comprising:

a container body;

a container bottom closing one end of said container body;

a container cover of sheet metal closing an opposite end of said container body, said container cover being formed with at least one filling opening and, bounding said opening and formed in one piece with said cover, a tube stub having an external screw thread and defining an annular sealing surface surrounding said opening and located on a side of said cover turned away from said container body; and an internally threaded cap threadedly received removably on said tube stub, forming a closure for said opening and having a sealing ring pressed against said surface, said tube stub being double-walled and having an inner wall joined to said cover and an outer wall joined to said inner wall at a transition portion forming said annular sealing surface, said transition portion having a minimum radius of curvature and said outer wall lying directly against said inner wall.

2. The cap-type-closure container defined in claim 1 wherein said transition region has a relatively large radius of curvature and said outer wall is spaced from said inner wall at least adjacent said transition region.

3. The cap-type-closure container defined in claim 1 wherein said transition region is formed with a planar surface perpendicular to an axis of said tube stub and forming said annular sealing surface.

4. A cap-type-closure container, comprising:

a container body;

a container bottom closing one end of said container body;

a container cover of sheet metal closing an opposite end of said container body, said container cover being formed with at least one filling opening and, bounding said opening and formed in one piece with said cover, a tube stub having an external screwthread and defining an annular sealing surface surrounding said opening and located on a side of said cover turned away from said container body; and an internally threaded cap threadedly received removably on said tube stub, forming a closure for said opening and having a sealing ring pressed against said surface, said tube stub being double-walled and having an inner wall joined to said cover and an outer wall joined to said inner wall at a transition portion forming said annular sealing surface, said transition portion having a frustoconical configuration.

5. The cap-type-closure container defined in claim 4 wherein said transition region converges in a direction into said filling opening toward said container body.

6. The cap-type-closure container defined in claim 4 wherein said transition region converges away from said container body.

7. A cap-type-closure container, comprising:

a container body;

a container bottom closing one end of said container body;

a container cover of sheet metal closing an opposite end of said container body, said container cover being formed with at least one filling opening and, bounding said opening and formed in one piece with said cover, a tube stub having an external screwthread and defining an annular sealing surface surrounding said opening and located on a side of said cover turned away from said container body; and an internally threaded cap threadedly received removably on said tube stub, forming a closure for said opening and having a sealing ring pressed against said surface, said tube stub being double-walled and having an inner wall joined to said cover and an outer wall joined to said inner wall at a transition portion forming said annular sealing surface, said inner wall having an inner step separating a large-diameter portion adjoining said cover from a small-diameter portion adjoining said transition portion and said outer wall lying against said large-diameter portion.

8. A cap-type-closure container, comprising:

a container body;

a container bottom closing one end of said container body;

a container cover of sheet metal closing an opposite end of said container body, said container cover being formed with at least one filling opening and, bounding said opening and formed in one piece with said cover, a tube stub having an external screwthread and defining an annular sealing surface surrounding said opening and located on a side of said cover turned away from said container body; an internally threaded cap threadedly received removably on said tube stub, forming a closure for said opening and having a sealing ring pressed against said surface, said tube stub being double-walled and having an inner wall joined to said cover and an outer wall joined to said inner wall at a transition portion forming said annular sealing surface; and a reinforcing ring received and anchored between said outer wall and said inner wall.

* * * * *